United States Patent [19]

Resuggan

[11] Patent Number: 4,923,182

[45] Date of Patent: May 8, 1990

[54] SPRING ENERGIZED AIR GUNS

[75] Inventor: Harold F. Resuggan, Birmingham, Great Britain

[73] Assignee: Webley & Scott Limited, United Kingdom

[21] Appl. No.: 204,244

[22] Filed: Jun. 9, 1988

[30] Foreign Application Priority Data

Jun. 13, 1987 [GB] United Kingdom ..... 8713857

[51] Int. Cl.[5] ..... F41B 11/00

[52] U.S. Cl. ..... 267/169; 124/67; 267/291

[58] Field of Search ..... 267/204, 286, 287, 196, 267/136, 182, 166, 291, 169, 141; 5/253, 261, 309; 181/207, 208, 209; 124/65, 66, 67, 68

[56] References Cited

U.S. PATENT DOCUMENTS

| | | | |
|---|---|---|---|
| 2,189,208 | 2/1940 | Holland | 267/204 |
| 2,219,001 | 10/1940 | Woodman | 267/204 |
| 2,436,163 | 2/1948 | Christenson | 267/204 |
| 3,141,660 | 7/1964 | Clarke et al. | 267/166 |
| 3,326,545 | 6/1967 | Bache et al. | 267/287 |
| 3,899,845 | 8/1975 | Wild et al. | 124/68 X |
| 4,165,730 | 8/1979 | Jaedicke et al. | 124/67 |
| 4,540,076 | 9/1985 | Yonovitch et al. | 267/141 X |
| 4,716,668 | 1/1988 | Hahn | 67/182 X |
| 4,732,372 | 3/1988 | Dickhart, III et al. | 267/287 X |

FOREIGN PATENT DOCUMENTS

| | | | |
|---|---|---|---|
| 0110233 | 6/1984 | European Pat. Off. | 267/141 |
| 2167538 | 5/1986 | United Kingdom . | |

*Primary Examiner*—Andres Kashnikow

*Attorney, Agent, or Firm*—Learman & McCulloch

[57] ABSTRACT

An anti-vibration damping device for the main spring of a piston air gun comprises an insert body extending longitudinally within the spring coils and a locating portion at one end on which an end of the spring seats, the insert body including resilient limb formations which are radially expanded to engage the interior of some of the spring coils.

10 Claims, 2 Drawing Sheets

SPRING ENERGIZED AIR GUNS

This invention relates to spring-energised air guns, particularly but not exclusively high velocity air rifles or air pistols, of the kind operated by a helical main spring which is released from a compressed condition to drive a piston along a cylinder, so compressing a charge of air which ejects a projectile from the barrel of the gun. Guns of this kind are hereinafter referred to as "piston air guns".

As the piston reaches the end of its travel on discharge the coils of the now slackened main spring tend to oscillate and/or vibrate both longitudinally and laterally within the spring housing producing a harsh "boing" noise and an unpleasant feel in the handling of the gun. The recoil effect on discharge may also be unduly prolonged or exaggerated due to such main spring vibration. These effects may upset the user's aim and concentration and the noise may not be acceptable in some circumstances, e.g. when stalking game.

It has been past practice, in some instances, to pack the main spring coils with grease in an effort to damp the unwanted vibrations and oscillation but this method is crude, the results are inconsistent and unpredictable, it only provides a short term remedy as the grease tends to be thrown clear of the spring coils, and the presence of the grease may slow or otherwise adversely effect performance.

The object of the invention is to provide main spring damping in a reliable and particularly effective way with results which are consistent and effective in the long term.

According to the invention there is provided a damping device for the main spring of a piston air gun as hereinbefore defined comprising an insert portion body formed to extend longitudinally within the spring and a locating portion at a proximal end of the insert portion having a radially projecting flange formation which is operatively trapped between an end face of the spring and an abutment surface against which the spring reacts in use, a region at or towards a distalend of the insert portion being divided longitudinally into two or more limb formations which are resiliently expanded radially outwards to engage the interior of coils of the spring at or passing over said region in use.

Preferably the device is a unitary moulding of plastics material.

Said region may include the extreme distal end of the insert portion, the entire end part being split to form two or more limb formations whose distal extremities are separated from each other.

However, in the preferred form of the invention, said region does not include the distal extremity and the limb formations, preferably two in number, are separated by a through aperture or slot having closed ends, the limb formations being resiliently bowed radially outwardly to engage a plurality of the spring coils in that region.

Conveniently the latter limb formations are shaped to contact said coils at four equi-angular or near equi-angular locations about the mean axis of the spring.

An example of the invention is now more particularly described with reference to the accompanying drawings in which FIG. 1 is a part sectional side elevation of a damping device;

This example of a damping device 1 is for the power main spring 2 of an air rifle 3 and is a unitary moulding of plastics material, for example that supplied under the Trade Mark or Trade Name "DELRIN".

Figure 6:
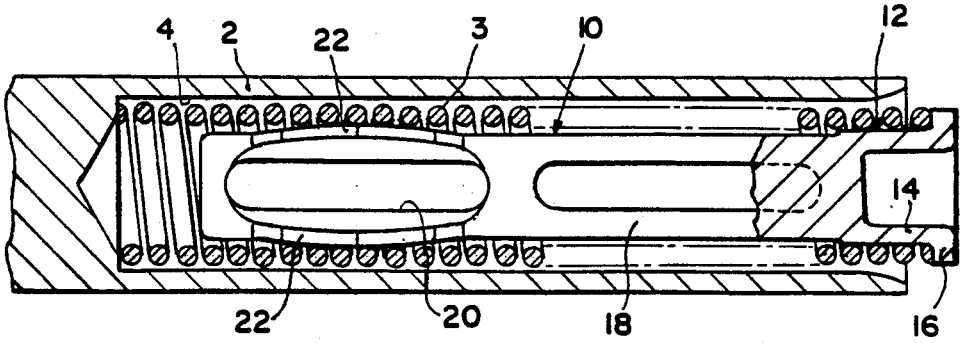
FIG. 6 is a fragmentary, partly sectional view illustrating the damping device fitted within a spring and accommodated in the piston of a conventional air gun.

The air gun has a piston 2 having a bore 4 within one end of which are accommodated the damping device and the spring 3 as is shown in FIG. 6.

The damping device is about 12 cm in overall length and consists of a generally cylindrical insert body 10 which extends longitudinally within the coils of the spring 3 and constitutes a major part of the length of the damping device. At one end of the body 10 is an enlarged, short locating portion 12. The locating portion 12 comprises a hollowed stub section 14 whose diameter is a press fit with two or three of the end coils of the spring 3 (in the example the inside diameter of the latter is nominally about 15.8 mm) with the extreme proximal end part shaped to provide a radially projecting flange 16 on which one end of the spring 3 seats.

Body 10 is of reduced diameter inwardly of the locating portion 12 so that, apart from the limb formations referred to hereafter, there is clearance between its periphery and the spring coils. It comprises a generally rigid shank section 18 connecting locating portion 12 to the distal end part of body 10 and formed with a pair of grooves or hollows along its opposite sides to reduce the material bulk and so facilitate the moulding process.

The distal end part of body 10 has a through slot 20 some 7.9 mm wide and 42 mm in maximum length so as to provide a pair of limb formations 22 united at their opposite ends and, in the unstressed condition shown in FIGS. 1-5 of the drawings, bowed somewhat radially outwardly of the generally cylindrical envelope of portion 10.

Figure 1:
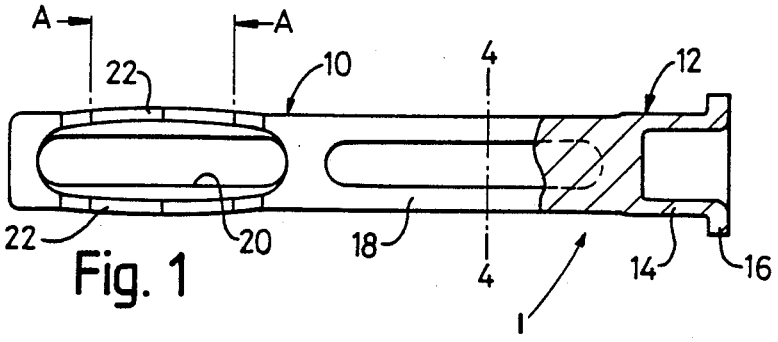
Figure 2:
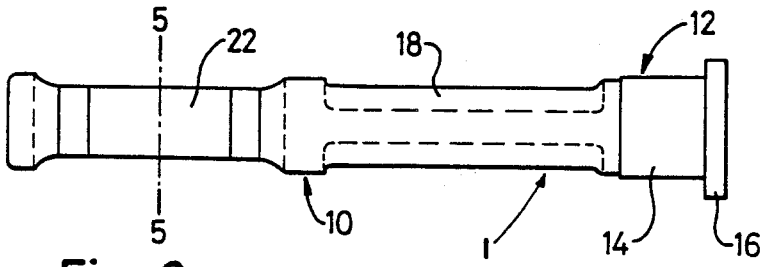
FIG. 2 is a plan view of said device.
Figure 3:
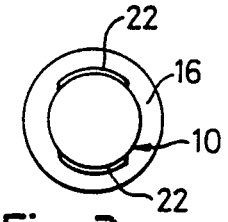
FIG. 3 is a distal end view thereof.
Figure 4:
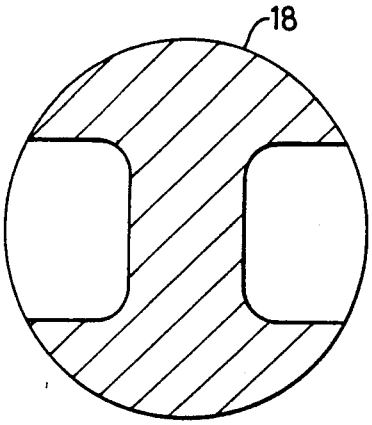
FIG. 4 is an enlarged cross-section on line 4—4 of FIG. 1.

When the body is inserted in the spring limb formations 22 are an interference fit within the spring cols in a region some 23.7 mm in axial length indicated by the arrows A—A in FIG.1 adjacent to but spaced from the distal extremity of the device.

In this region the limb formations are stressed radially inwardly to contact a number of the spring coils in the intermediate part of the spring.

Figure 5:
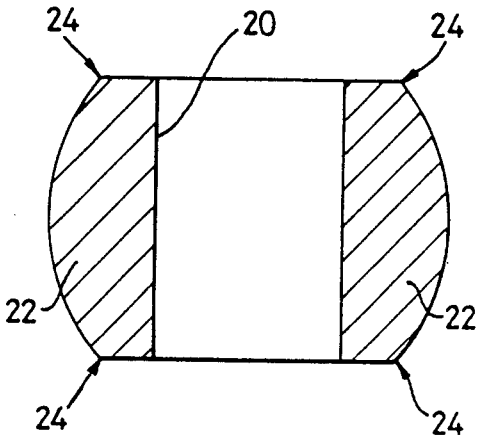
FIG. 5 is a like section on line 5—5 of FIG. 2; and body extending longitudinally

Preferably the curvature of the radially outer faces of formations 22 is such that, when deflected inwardly by engagement in the coils, their corners 24 shown in the large scale section FIG. 5 make line contact with the spring coils in that region at four angularly spaced locations about the spring axis.

The resilient contact of the limb formations 22 with the spring coils effectively dampens vibration and oscillation of the spring particularly on or following its sudden release from a compressed condition which takes place when the rifle is discharged. The frictional engagement with the interior of the coils at or as they pass through said region prevents lateral vibration, ringing, or oscillation against the side walls of the cylinder in which the spring locates, and also dampens or restricts any tendency the spring coils to oscillate in the longitudinal direction.

The abutment or seating of the end of the spring against the plastics flange 16 further deadens sound and other vibrations and resists any tendency of the end of the spring to bounce or knock against the abutment surface.

The device is simple and cheap to produce, is light in weight, does not add any complication to the assembly of the rifle or other gun and is durable and hard wearing in use, it should remain consistently effective over long periods of service and its performance is not substantially effected by heat or cold, unlike the grease packing sometimes used for the same purpose.

It is to be understood that the damping device could be made in other shapes and sizes to suit various types of piston air guns e.g. for air pistols or the like. More than two limb formations might be employed and/or instead of said formations being connected at their opposite ends one end of each formation might be free, for example the distal end part of insert portion, body 10 might be split through the extreme end thereof to provide a plurality of limb formations whose free distal ends are splayed outwardly for engagement with the spring coils.

I claim:

1. In a spring energized air gun having a slidable piston and a helical compression spring engageable with said piston and being operable to drive the latter along a path when said spring is released from a compressed condition, the improvement comprising a damping device for damping radial and axial oscillations of said spring in response to decompression of said spring, said damping device comprising an elongate body accommodated within and encircled by said spring, said body having at one end thereof a radially projecting flange on which one end of said spring seats, said body having adjacent its opposite end a plurality of resilient, radially projecting limbs in engagement with said spring, said body having a major portion of its length between its ends of such size as to provide radial clearance between said body and said spring.

2. The damping device according to claim 1 wherein said limbs are angularly spaced from one another circumferentially of said body.

3. The damping device according to claim 2 wherein said limbs are bowed radially outwardly between their opposite ends.

4. The damping device according to claim 2 wherein said limbs are two in number and are diametrally opposite each other.

5. The damping device according to claim 2 wherein said limbs have radially outward, arcuate surfaces.

6. The damping device according to claim 2 wherein said limbs are separated from one another by slots in said body.

7. The damping device according to claim 1 wherein said body comprises a unitary moulding.

8. The damping device according to claim 1 wherein said one end of such body has an interference fit with said spring.

9. The damping device according to claim 1 wherein said limbs have an interference fit with said spring.

10. The damping device according to claim 1 wherein said body has a length less than that of said spring when the latter is in its compressed condition.

* * * * *

UNITED STATES PATENT AND TRADEMARK OFFICE

CERTIFICATE OF CORRECTION

PATENT NO. : 4,923,182

DATED : May 8, 1990

INVENTOR(S) : Harold F. Resuggan

It is certified that error appears in the above-identified patent and that said Letters Patent is hereby corrected as shown below:

Column 2, line 43, change "cols" to -- coils --.

Column 3, line 17, cancel "insert portion".

Signed and Sealed this

Eighth Day of October, 1991

*Attest:*

HARRY F. MANBECK, JR.

*Attesting Officer*

*Commissioner of Patents and Trademarks*